United States Patent [19]

Sando et al.

[11] 4,182,143

[45] Jan. 8, 1980

[54] HIGH PRESSURE STEAMER INCORPORATING MONOMER RECOVERING MECHANISM

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 968,780

[22] Filed: Dec. 12, 1978

[30] Foreign Application Priority Data

Dec. 20, 1977 [JP] Japan ..... 52-153151

[51] Int. Cl.[2] ..... D06B 3/10; D06B 21/02

[52] U.S. Cl. ..... 68/5 E; 68/9

[58] Field of Search ..... 68/5 D, 5 E, 9

[56] References Cited

U.S. PATENT DOCUMENTS 3,083,073 3/1963 Leins et al. ..... 68/5 E X 3,651,671 3/1972 Sando et al. ..... 68/5 E

FOREIGN PATENT DOCUMENTS 47-23699 7/1972 Japan ..... 68/5 E 51-14634 5/1976 Japan ..... 68/9

*Primary Examiner*—Philip R. Coe

*Attorney, Agent, or Firm*—Toren, McGeady and Stanger

[57] ABSTRACT

A high pressure steamer for high hygro-thermic treatment of a cloth material, comprising a drum body which is capable of maintaining a high humid heat of 110° to 160° C. therein and is arranged to continuously introduce the cloth material thereinto and to guide it out therefrom, a cloth material transporting mechanism which conveys the cloth material in a no tension and relaxed state and a slow cooling tank which gradually cools the conveyed cloth material down to about 50° C. The high pressure steamer incorporates therein a monomer recovering mechanism wherein, between the end part of the cloth material transporting mechanism and the slow cooling tank, there is provided a washing tank for washing off a monomer sticking to the cloth material, which is made of, for example, polyester fiber. The washing tank is equipped with a waste liquid discharge pipe arranged to guide to the outside of the high pressure steamer a washing treatment liquid which contains the monomer washed off the cloth material.

1 Claim, 3 Drawing Figures

HIGH PRESSURE STEAMER INCORPORATING MONOMER RECOVERING MECHANISM

BACKGROUND OF THE INVENTION

1. Field of the Invention

This invention relates to a high pressure steamer for carrying out a weight reducing process for a cloth material such as a polyester fabric product and more particularly to a high pressure steamer which effectively permits recovery of a monomer separated from the polyester fiber of a cloth material through the weight reducing process.

2. Description of the Prior Art

The present inventors have filed many patent applications for cloth material weight reducing processes which are carried out speedily and continuously by supplying a polyester fabric product such as a cloth material made of polyester fiber into a high pressure steamer in which a high pressure humid heat is maintained and by subjecting the cloth material in its relaxed state to a hygro-thermic treatment. In accordance with the prior arts of weight reducing processes of this type, however, it has been impossible to effectively recover the monomer which is produced from the polyester by an alkali reaction on the polyester fiber during the weight reducing process. The cloth material is thus gradually cooled without complete removal of the monomer which is separating from the polyester fiber and then the cloth material is guided to the outside of the steamer to be further cooled down there. Therefore, with these prior arts, it has been impossible to obtain a cloth material of a good texture or a mercerization effect thereon as desired.

SUMMARY OF THE INVENTION

It is therefore an object of this invention to provide a high pressure steamer including a washing tank which is supplied with warm water and is disposed and arranged within the high pressure steamer in the vicinity of a cloth material output port of the steamer to wash the cloth material after it has undergone a weight reducing treatment within the high pressure steamer and before it is cooled, so that the monomer sticking to the fiber of the cloth material can be effectively removed within the high pressure steamer.

The above and other related objects and features of the invention will be apparent from the following detailed description of embodiments thereof when read in connection with the accompanying drawings.

BRIEF DESCRIPTION OF THE DRAWINGS

All of the accompanying drawings show the embodiments of the high pressure steamer of the present invention.

DETAILED DESCRIPTION OF PREFERRED EMBODIMENTS

EMBODIMENT 1

Figure 1:
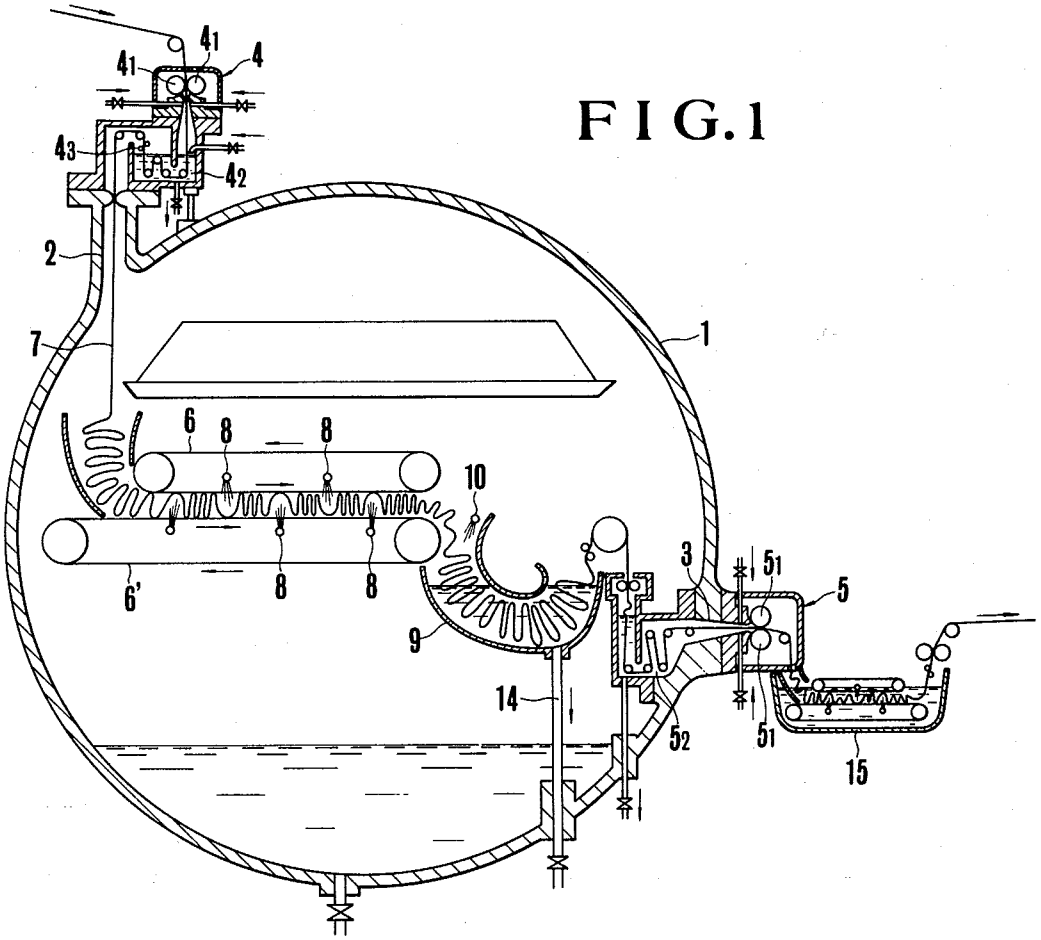
FIG. 1 is a schematic illustration showing the structural arrangement of a first embodiment example.

Referring to FIG. 1 which shows a high pressure steamer as the first embodiment of the invention, a drum body 1 of the high pressure steamer which is adapted for treating a cloth material under a high pressure humid heat, the steamer drum body is provided with a cloth material inlet port 2 and a cloth material outlet port 3. At the cloth material inlet port 2 and the cloth material outlet port 3, there are provided an entrance side seal mechanism 4 and an exit side seal mechanism 5 respectively. These seal mechanisms are arranged to allow the cloth material to be introduced into the drum body 1 and to be guided to the outside of the drum body 1 while keeping a high humid heat unchanged within the high pressure steamer drum body 1. The entrance side seal mechanism 4 includes a pair of seal rubber rolls $4_1$ pressed against each other, a liquid seal tank $4_2$ disposed closer to the inlet port 2 than the seal rubber rolls $4_1$ and wringer rolls $4_3$. The exit side seal mechanism 5 includes a pair of seal rubber rolls $5_1$ which are pressed against each other and a slow cooling liquid seal tank $5_2$ which is disposed closer to the outlet port 3 than the seal rubber rolls $5_1$. Within the steamer drum body 1, there are provided metal net conveyers 6 and 6' which are arranged in upper and lower positions to have a cloth material 7 gradually conveyed between them. Also provided within the drum body 1 are humid heat steam blowing tubes 8 which are arranged to apply a humid heat to the cloth material 7 while it is conveyed between the metal net conveyers 6 and 6' in a relaxed state. Between the end parts of the net conveyers 6 and 6' and the above stated slow cooling liquid seal tank $5_2$, there is provided a washing tank 9 which is arranged to have washing warm water gradually supplied thereto through a washing warm water supply port 10. The tank 9 is provided with a waste liquid discharge pipe 14. A reference numeral 15 indicates a water washing tank. The embodiment of the invention arranged as described in the foregoing operates as follows:

First the inside of the steamer drum body is arranged to maintain a high humid heat of 120° to 150° C. The liquid seal tank $4_2$ of the entrance side seal mechanism 4 is filled, for example, with a caustic liquid. The washing tank 9 is supplied with the washing liquid to have a liquid flow therethrough; and water is constantly supplied to the inside of the low cooling liquid seal tank $5_2$ in such a manner as to have the temperature of water in the slow cooling liquid seal tank $5_2$ is arranged not exceeding 50° C. at the exit part of the tank $5_2$.

Then, the cloth material 7 to be processed, such as a polyester fabric product, is allowed to pass through the entrance side seal mechanism 4 and is immersed in the caustic liquid contained in the liquid seal tank $4_2$. Following this, the cloth material is allowed to pass through the wringer rolls $4_3$ to make it impregnated with a desired quantity of the caustic liquid before it is supplied to the inside of the steamer drum body 1. The cloth material which is thus supplied to the drum body 1 comes in between the upper and lower net conveyers and is conveyed there as the net conveyers rotate. While being conveyed in this manner, the cloth material 7 is subjected to the steam blowing action of the humid heat blowing tubes 8 as well as to the high pressure humid heat within the steamer drum body 1. The cloth material 7 is thus steamed in a relaxed condition and is subjected to a weight reducing process through the reaction of the caustic liquid. The weight reduced cloth material 7 is then supplied to the inside of the washing tank 9 to be immersed in the washing liquid, which is warm water of temperature adjusted to th temperature in the drum body 1. The cloth material 7 is then gradually moved forward inside the washing tank by the liquid flow. While the cloth material 7 is thus moved forward inside the washing tank 9, a monomer produced by the reaction which has taken place on the conveyer is completely removed from the surface of the polyester fiber of the cloth material 7.

The cloth material 7 is then supplied to the inside of the slow cooling liquid seal tank $5_2$ and is gradually cooled down to 50° C. or thereabout within the slow cooling liquid seal tank $5_2$ so that the shrinkage of the cloth material 7 is set there. With its shrinkage having been set, the cloth material is guided to the outside of the steamer drum body 1 through the seal rubber rolls $5_1$.

As described in the foregoing, in accordance with the invention, the cloth material which has been subjected to a weight reducing process within the steamer drum body 1 is washed with warm water while the heat of the cloth material is still maintained, so that the monomer sticking to the surface of the polyester fiber can be very effectively removed from the fiber for satisfactory accomplishment of the weight reducing process. Further, the washing liquid which contains the monomer is arranged to be recovered and filtered outside the steamer. The monomer which is recovered in this manner can be used again. Then, the water which is separated from the monomer also can be used, so that the possibility of environment pollution due to waste water can be avoided thereby. Further, in the case of the present embodiment, the cloth material outlet port 3 is disposed in the side wall of the steamer drum body 1 to obviate the necessity of pulling the cloth material upward under the humid heat condition. Therefore, the cloth material is kept free from any tension, so that the texture of the cloth material will not be impaired.

EMBODIMENT 2

Figure 2:
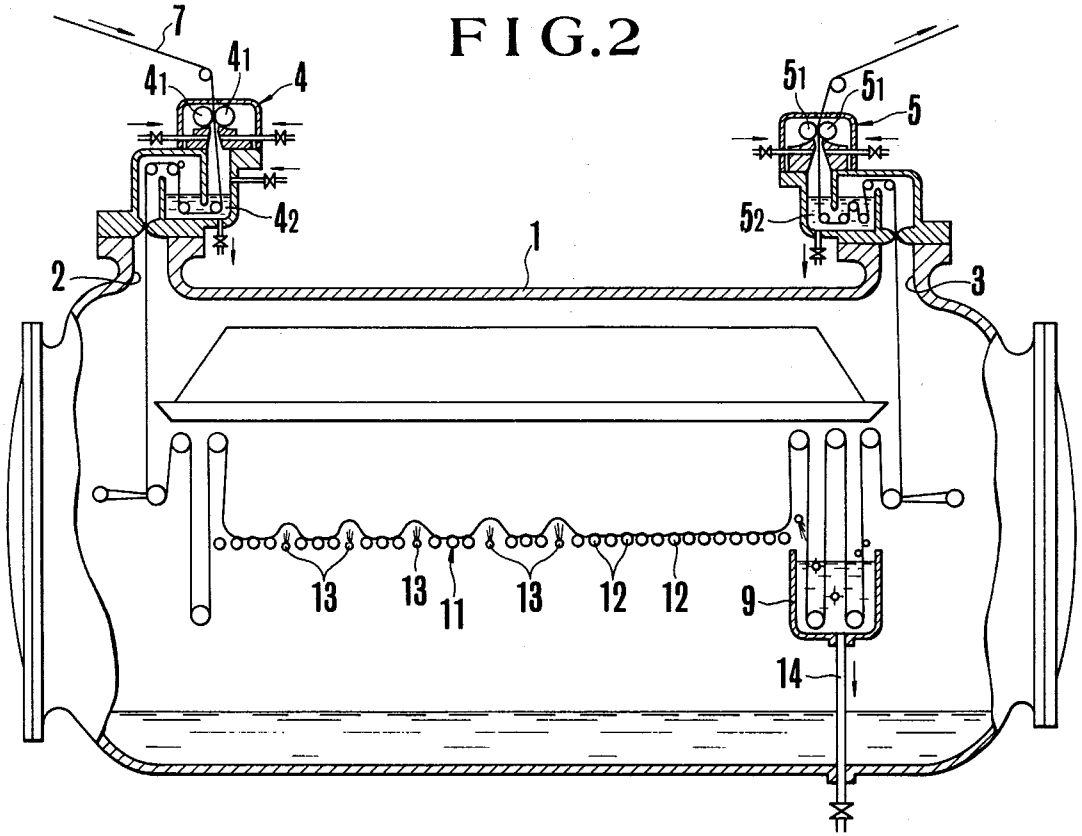
FIG. 2 is also a schematic illustration showing the structural arrangement of a second embodiment.

FIG. 2 shows another embodiment wherein the cloth material conveying means which consists of the upper and lower net conveyers 6 and 6' in Embodiment 1 is replaced by a roll conveyer 11. In this embodiment example, the roll conveyer is formed by arranging many driving rolls 12 within the steamer drum body 1 in the transverse direction with steam blowing tubes 13 disposed in suitable parts of the roll conveyer 11. Therefore, while the cloth material 7 supplied to the inside of the steamer drum body 1 is conveyed on the roll conveyer 11, the cloth material receives a swaying force from the steam blowing tubes 13 and thus is subjected to a weight reducing process under the humid heat of the steamer in a no tension (relaxed) condition. The cloth material 7 which has undergone the weight reducing process in this manner is supplied to the inside of the washing tank 9. The washing treatment of the cloth material is then carried out in the same manner as in the preceding embodiment example to effectively accomplish the monomer removing and recovering processes to which the present invention is directed.

EMBODIMENT 3

Figure 3:
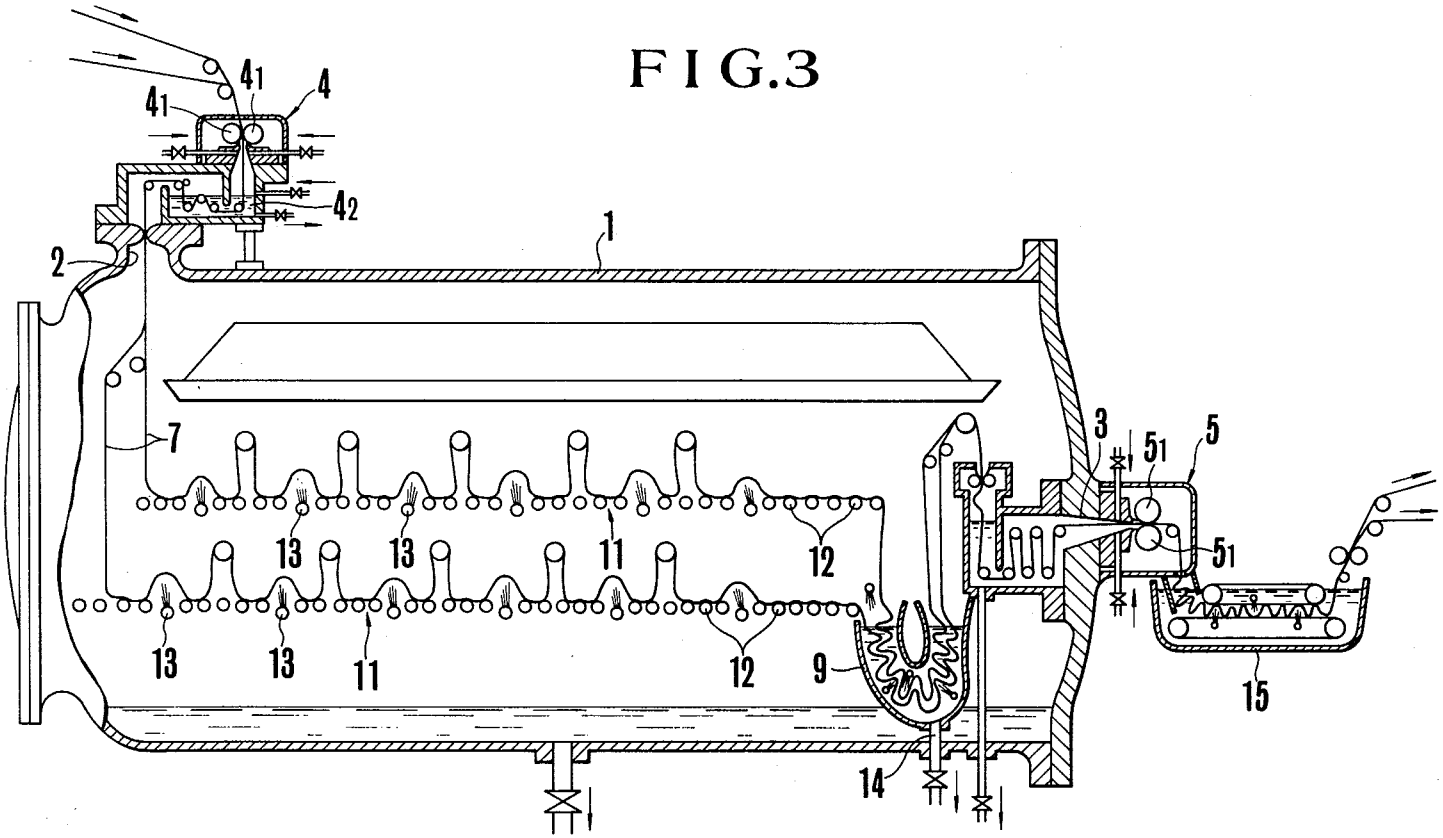
FIG. 3 is another schematic illustration showing a third embodiment of the invention.

In the embodiment shown in FIG. 3, the roll conveyer 11 which is arranged in a single row in Embodiment 2 is arranged in two rows in this case to permit carrying out weight reducing process on two cloth materials simultaneously. The high pressure steamer is also provided with the washing tank 9 which is arranged inside the drum body 1 to effectively accomplish the processes of removing the monomer from the polyester fiber of the cloth material and recovering the monomer to effectively attain the purpose of the invention.

What is claimed is:

1. A high pressure steamer for high hygro-thermic treatment of a cloth material comprising a drum body which is capable of maintaining a high humid heat of 110° to 160° C. therein and which is arranged with means to continuously introduce said cloth material thereinto and guide it out therefrom, a cloth material transporting mechanism within said high pressure steamer which conveys the cloth material in a no tension and relaxed state through the high humid heat atmosphere within said high pressure steamer and a slow cooling tank within said high pressure downstream of the transporting mechanism which gradually cools the conveyed cloth material down to a temperature of about 50° C., said high pressure steamer further including therein a monomer recovery mechanism located between the end part of the transporting mechanism and the slow cooling tank, the monomer recovering mechanism comprising a washing tank for washing off a monomer sticking to the cloth material, the washing tank being equipped with a waste liquid discharging pipe to guide to the outside of said drum body a washing treatment liquid which contains said monomer washed from said cloth material.

* * * * *